US006125912A

United States Patent [19]

Branagan et al.

[11] Patent Number: 6,125,912

[45] Date of Patent: Oct. 3, 2000

[54] ADVANCED NEUTRON ABSORBER MATERIALS

[75] Inventors: Daniel J. Branagan; Galen R. Smolik, both of Idaho Falls, Id.

[73] Assignee: Bechtel BWXT Idaho, LLC, Idaho Falls, Id.

[21] Appl. No.: 09/243,229

[22] Filed: Feb. 2, 1999

Related U.S. Application Data

[60] Provisional application No. 60/075,350, Feb. 2, 1998.

[51] Int. Cl.[7] ..... B22D 11/06; B29B 9/00; C22C 38/00

[52] U.S. Cl. ..... 164/46; 164/463; 148/301

[58] Field of Search ..... 164/462, 463, 164/46; 148/101, 102, 103, 105, 301, 302, 304, 108; 428/655, 900; 420/83, 121, 455

[56] References Cited

U.S. PATENT DOCUMENTS

| | | | |
|---|---|---|---|
| Re. 34,322 | 7/1993 | Koon | 148/103 |
| 4,533,408 | 8/1985 | Koon | 148/103 |
| 4,723,994 | 2/1988 | Ovshinsky et al. | 147/103 |
| 5,538,565 | 7/1996 | Akioka et al. | 148/101 |
| 5,916,376 | 6/1999 | Fukuno et al. | 164/463 |

*Primary Examiner*—Kuang Y. Lin
*Attorney, Agent, or Firm*—Alan D. Kirsch

[57] ABSTRACT

A neutron absorbing material and method utilizing rare earth elements such as gadolinium, europium and samarium to form metallic glasses and/or noble base nano/microcrystalline materials, the neutron absorbing material having a combination of superior neutron capture cross sections coupled with enhanced resistance to corrosion, oxidation and leaching.

15 Claims, 19 Drawing Sheets

ADVANCED NEUTRON ABSORBER MATERIALS

RELATED APPLICATION

This application claims priority from provisional application S/No. 60/075,350 filed Feb. 2, 1998.

CONTRACTUAL ORIGIN OF THE INVENTION

The United States has rights in this invention pursuant to Contract No. DE-AC07-94ID13223 between the U.S. Department of Energy and Lockheed Martin Idaho Technologies Company.

BACKGROUND OF THE INVENTION

This invention relates to advanced neutron absorbing materials and more specifically to neutron absorbing materials utilizing rare earth elements such as gadolinium, europium and samarium in amorphous metallic glasses and/or noble based nano/microcrystalline materials.

The need for better neutron absorbing materials has become an issue in the disposition of highly enriched spent nuclear fuels (SNF). Boron based neutron absorbing alloys have limited neutron capturing capabilities which can decrease with the loss of boron though leaching. Cost effectiveness prompts an optimum loading of the enriched SNF in canisters. Loading efficiencies of the canisters can be improved by including neutron absorbing materials as structural components or as backfill to ensure that subcritical conditions are maintained.

Nearly all present day nuclear absorber materials are designed with careful and detailed consideration to the nuclear, mechanical, and corrosion characteristics of the alloys. Additional factors such as fabrication ability and the cost and availability of the starting materials are also important considerations in selecting neutron absorber materials.

Rare earth elements (lanthanum through lutetium), and more specifically gadolinium, samarium and europium are good candidate elements for neutron absorber materials due to their extremely high microscopic neutron capture cross sections. However, rare earth elements in their pure form cannot be directly used for these absorber applications because the corrosion resistance of these elements is exceedingly poor.

It is an object of the present invention to provide a noble metallic matrix incorporating rare earth elements whereby the rare earth elements are protected from corrosion, oxidation and leach resistance.

It is another object of the present invention to provide an amorphous metallic glass and/or nano/microcrystalline material (hereinafter sometimes referred to as fine crystalline structure) designed with corrosion resistance and having high macroscopic nuclear cross sections.

It is still a further purpose of the present invention to provide a material in particulate form that can also be processed into consolidated forms making it useful for many nuclear applications where criticality control is desired.

SUMMARY OF THE INVENTION

To achieve the foregoing and other objects, the present invention provides a neutron absorbing material and a method of making neutron absorbing materials, the method comprises providing a base alloy composition consisting of one or more rare earth elements and a transition metal selected from the group consisting of iron, cobalt, nickel, copper, silver and mixtures thereof. The base alloy composition is heated to a temperature above its melting temperature and rapidly solidified to form ribbons having amorphous and nano/microcrystalline structure. Preferably the rare earth elements are selected from the group consisting of gadolinium, samarium and europium. In an alternate embodiment of the present invention, the base composition melt can be rapidly solidified using atomization methods to form particulates. In a further embodiment of the present invention, the base alloy composition can be further comprised of a interstitial element selected from the group consisting of boron, carbon, silicon and phosphorous.

BRIEF DESCRIPTION OF THE DRAWINGS

The present invention is illustrated in the accompanying drawings where.

DETAILED DESCRIPTION OF THE INVENTION

Figure 1A:
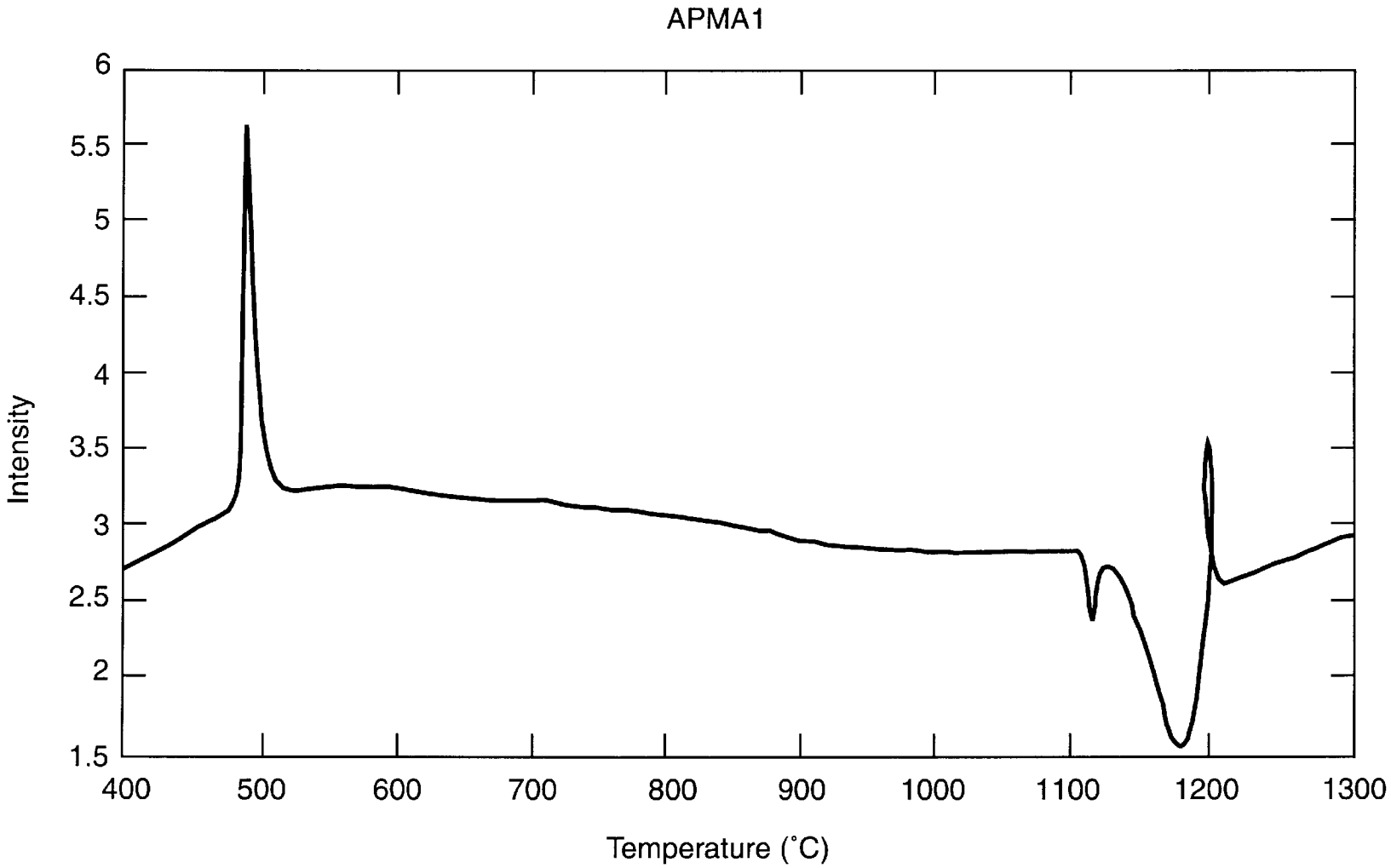
FIGS. 1A through 1N are differential thermal analysis scans of advanced neutron absorber materials containing gadolinium.

The present invention comprises lanthanide-bearing amorphous metallic glass and/or lanthanide-bearing noble based nano/microcrystalline materials. Metallic glass structures can be partially devitrified to yield partial nanocrystalline/partial amorphous structures or fully devitrified to yield nanocrystalline scaled microstructures, or nano/microcrystalline structures formed during solidification or subsequent processing.

Amorphous metallic glasses are formed by rapidly cooling a liquid melt at $10^4$ to $10^6$ K/s. Alloying advantages include the ability to extend solid solubility limits and to incorporate elements into closer contact that normally will not exist together. Therefore, a wide range of chemical compositions can be devised and the resulting properties can be tailored for a particular application. Other advantages of metallic glasses are their extremely good corrosion, oxidation and leaching resistance which arises from near perfect homogeneity which does not allow sites for anodic attack.

Elements of high and extremely high microscopic neutron absorption cross sections, such as selected rare earths, can be incorporated into alloy systems, thereby forming metallic glasses having superior neutron absorbing capabilities relative to existing materials whose neutron absorbing abilities arise from additions of natural occurring boron, or even the chemically separated B-10 isotope. Through careful development of alloys with low critical cooling rates for metallic glass formation, existing commercial scale processing techniques, such as melt-spinning, splat quenching, piston and anvil, gas atomization, water atomization and centrifugal atomization can be utilized to produce large quantities of amorphous metallic glasses or fine structured powders.

Iron based alloys are particularly attractive as a host for neutron absorbers due to the low cost of the base metal. Additionally, steel is one of the most widely used materials, so a neutron absorbing material based on iron would be compatible with existing steel alloys. Iron based systems are especially useful for spray coating by processes such as high-energy plasma (HPS), low pressure plasma spraying (LPPS), high-velocity oxyfuel (HVOF), and other spray forming processes on existing steel surfaces such as storage containers and steel drums.

Iron, as well as conventional steel alloys cannot be made amorphous by conventional casting methods or even by rapid solidification methods. Large additions of glass forming elements are necessary in order to make iron based metallic glasses. Boron is an especially potent glass forming additive element. From the Fe—B binary phase equilibrium diagram, a low melting point (1174° C.) eutectic occurs at 17 at % B. In general, compositions near low melting point eutectics can be solidified into a glass due to the close balance of free energies of the constituent eutectic phases leading to atomic frustration and an inability to crystallize. The $Fe_{80}B_{20}$ (Metglass) composition is well known as a glass forming system and has been well studied as a soft magnetic material for transformer cores. Adding rare earth elements (0 to 50 at %) additionally increases the glass forming ability of the iron based compositions.

The homogeneous nature of the metallic glass allows the incorporation of a wide range of compositions. Virtually any range of elements, which can be dissolved in the liquid can be dissolved in a metallic glass, which is simply a supercooled liquid. Iron based compositions with approximately 20 at % of interstitial elements (boron, carbon, phosphorous and silicon) will generally form metallic glasses when rapidly solidified. Additionally, in the glass, the rare earth elements are easily incorporated from 0 to 50 at %. To maximize the corrosion resistance of the glass, pseudo stainless steel compositions (304, 304L 316, etc.) can be developed by substituting nickel and chromium for iron in the glass.

Nickel as an extremely attractive base metal due to it nobility and general resistance to oxidation and chemical attack. Additionally, the formation of a nickel base amorphous structure gives another layer of protection for an already corrosion resistance material.

From the relevant physical metallurgy and phase diagrams, nickel appears to behave similarly to iron. That is, approximately 20 at % of interstitial elements are necessary in order to produce metallic glass during rapid solidification. The incorporation of rare earth materials into the glass is possible over a similar composition range (0 to 50 at %) to the iron base system. Again, a wide variation of elements can be incorporated into the glass depending on the material requirements of specific applications.

Iron or nickel based compositions can be partially or fully devitrified to yield partially nanocrystalline/partially amorphous structures or nano/microcrystalline scaled microstructures. Devitrification can be done simply by heating the material above the glass crystallization temperature, which varies according to the composition, but is typically between 500° C. to 700° C. Atomized powders have particle size distribution and size ranges that are dependent upon the melt composition and process parameters for a given run. Each powder size cools at a different rate; finer powder particles cool faster than larger powder particles. After sieving the powder, a fraction of fine powders can be obtained which is fully amorphous, a size fraction with larger particles is partially crystalline/partially amorphous, and the size fraction with the largest powder particles can produce powders with a microcrystalline microstructure. Also, by melt-spinning, ribbons with the same range of microstructural evolution can be produced with the same alloy composition by performing several runs and varying the wheel tangential velocity (i.e., the faster the wheel tangential velocity, the faster the cooling rate).

As previously mentioned, a key to developing new neutron absorber materials is the successful incorporation of rare earth elements into a passive matrix phase, which will provide high resistance to electrochemical attack, such as corrosion, oxidation and leaching. One way to do this is to utilize noble metals, incorporating elements such as Ni, Cr, Mo, Ag, Co and Cu, since these elements contribute very good intrinsic resistance to corrosion in crystalline materials. Nickel and copper are face-centered cubic metals which means that they should form a matrix phase having high ductility and good mechanical forming characteristics as well as having good corrosion resistance.

In Fe, Ni or Cu base metal systems, rare earth addition results in favorable alloying behavior from a physical metallurgy standpoint. Since the rare earth elements all have the same outer shell electron configuration and since the outer shell bonding electrons determine the chemical reactivity, the rare earth elements exhibit very similar physical and metallurgical characteristics. In the examples set forth below, Gd is used since it is the most potent, neutron absorbing element, but all of the rare earth elements will behave similarly. Gadolinium has extremely low solid solubility in all of these binary systems at room temperature. Additionally, for each binary system, Gd addition promotes the formation of very thermodynamically stable intermetallic phases which greatly reduce the chemical reactivity of the Gd atom. In the Fe—Gd binary system, several stable intermetallic phases are found, including $Gd_2Fe_{17}$, $Gd_6Fe_{23}$ and $GdFe_3$.

From the Ni—Gd binary phase diagram, it can be found that Gd has no solubility in Ni at low temperatures. The addition of Gd to Ni results in the formation of thermodynamically stable intermetallic phases such as $Gd_2Ni_{17}$, $GdNi_5$ and $GdNi_4$. With fast cooling rates, these second phases can be made to be distributed either as a finely divided precipitate or in a lamellar or plate like morphology.

From the Cu—Gd binary phase diagram, it is found that Gd has no solubility in Cu, but forms thermodynamically stable intermediate phases such as $Cu_6Gd$, $Cu_4Gd_2$ and $Cu_2Gd$. These phases can be distributed as distinct second phases or in the form of lamellar plates.

The compositional ranges to be utilized are determined by the required neutron absorption characteristics, and the corrosion, physical and mechanical properties. Preferred composition ranges for each system are typically as follows: Fe—Gd from 0 to 50 at % Gd; Ni—Gd from 0 to 50 at % Gd; Cu—Gd from 0–50 at % Gd. In some case, by forming ternary or higher order systems with a multiple of these transition metals, synergistic enhancement of corrosion resistance can be obtained. For example, Monel 400 contains both Cu and Ni, and has been shown to have better corrosion resistance than either pure Cu or pure Ni.

Experimental Studies

Numerous experimental studies have been conducted at the Idaho National Engineering and Environmental Laboratory to develop appropriate composites and to understand the relevant physical metallurgy, physical characteristics and electrochemical properties of various amorphous metallic glasses and noble base nano/microcrystalline materials containing Gd. The following Table 1 shows the compositions and microstructure features of melt spun ribbons and atomized powders containing (1 and 8 at %) gadolinium:

TABLE 1

Alloy Composites and Solidification Characteristics

| Alloy | Composition | Characteristics |
|---|---|---|
| APMA1 | $(Fe_{0.8}B_{0.2})_{99}Gd_1$ | amorphous |
| APMA8 | $(Fe_{0.8}B_{0.2})_{92}Gd_8$ | amorphous achieved, Gd enhanced stability |
| APMB1 | $[(Fe_{0.8}Cr_{0.2})_{0.8}B_{0.2}]_{99}Gd_1$ | amorphous achieved |
| APMB8 | $[(Fe_{0.8}Cr_{0.2})_{0.8}B_{0.2}]_{92}Gd_8$ | amorphous, Gd enhanced stability |
| APMC1 | $(Ni_{0.8}B_{0.2})_{99}Gd_1$ | nanocrystalline |
| APMC8 | $(Ni_{0.8}B_{0.2})_{92}Gd_8$ | amorphous |
| APMD1 | $(Ni_{0.7}Cu_{0.3})_{99}Gd_1$ | microcrystalline with $GdNi_5$ and $Gd_2Ni_{17}$ |
| APMD8 | $(Ni_{0.7}Cu_{0.3})_{92}Gd_8$ | microcrystalline with $GdNi_5$ and $Gd_2Ni_{17}$ |
| APME1 | $[(Ni_{0.7}Cu_{0.3})_{0.8}B_{0.2}]_{99}Gd_1$ | nanocrystalline |
| APME8 | $[(Ni_{0.7}Cu_{0.3})_{0.8}B_{0.2}]_{92}Gd_8$ | partially crystalline/partially amorphous |
| APMF1 | $(C\text{-}22)_{99}Gd_1$ | microcrystalline |
| APMF8 | $(C\text{-}22)_{92}Gd_8$ | microcrystalline |
| APMG1 | $[(C\text{-}22)_{0.8}B_{0.2}]_{99}Gd_1$ | microcrystalline |
| APMG8 | $[(C\text{-}22)_{0.8}B_{0.2}]_{92}Gd_8$ | microcrystalline |

where C-22 = $Ni_{63.0}Cr_{24.6}Mo_{8.2}Fe_{3.3}W_{0.7}V_{0.2}$.

Figure 1B:
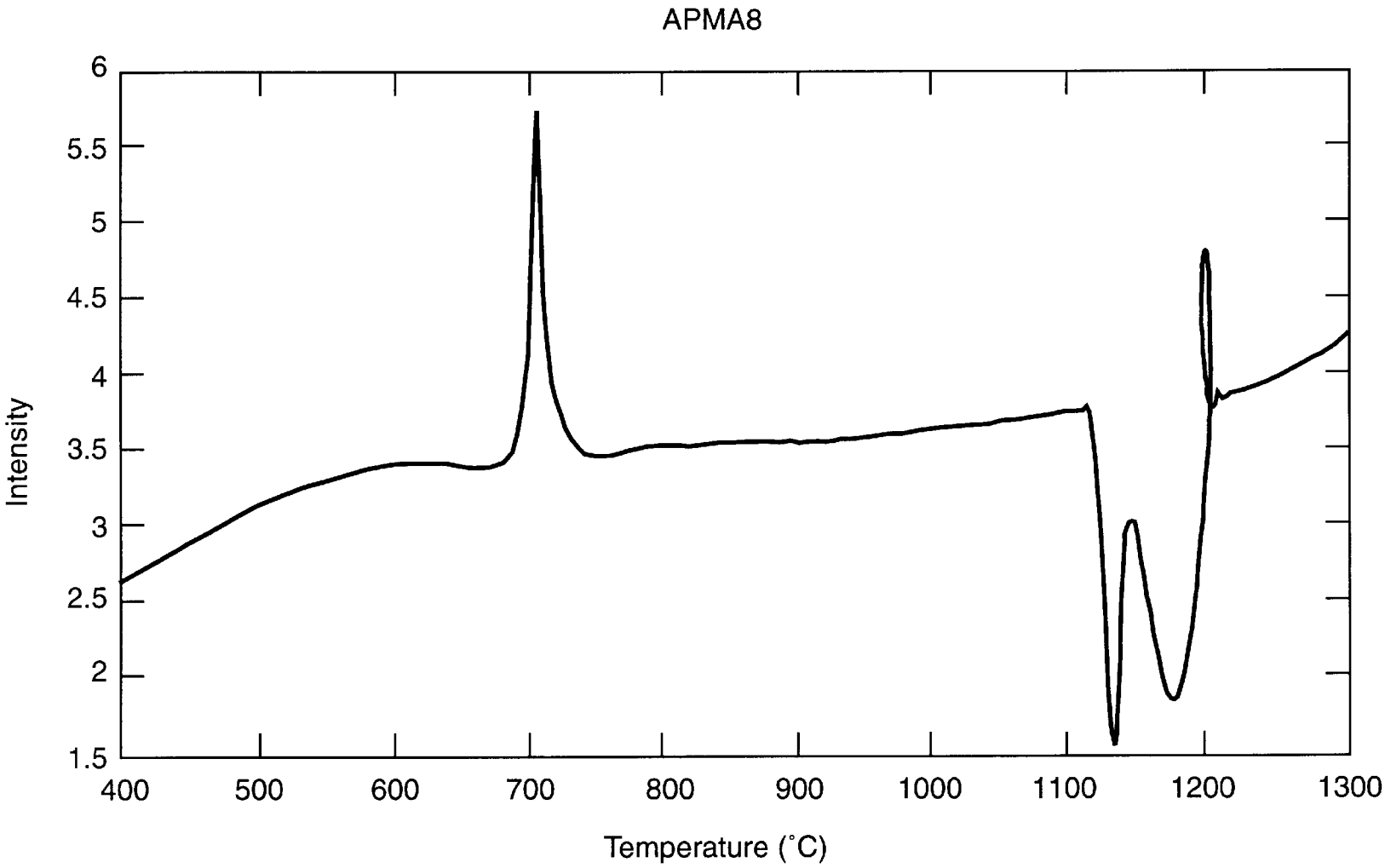
Figure 1C:
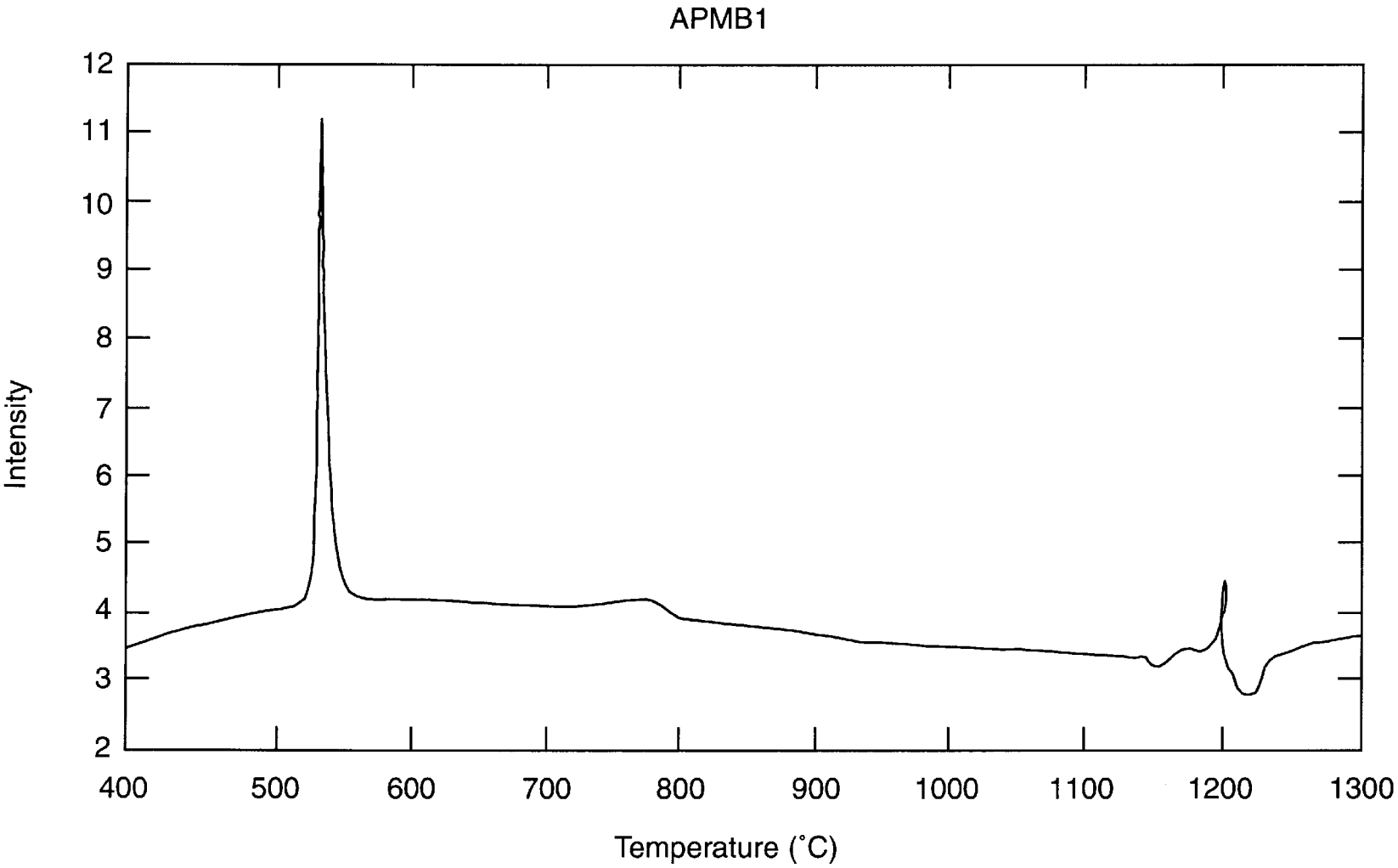
Figure 1D:
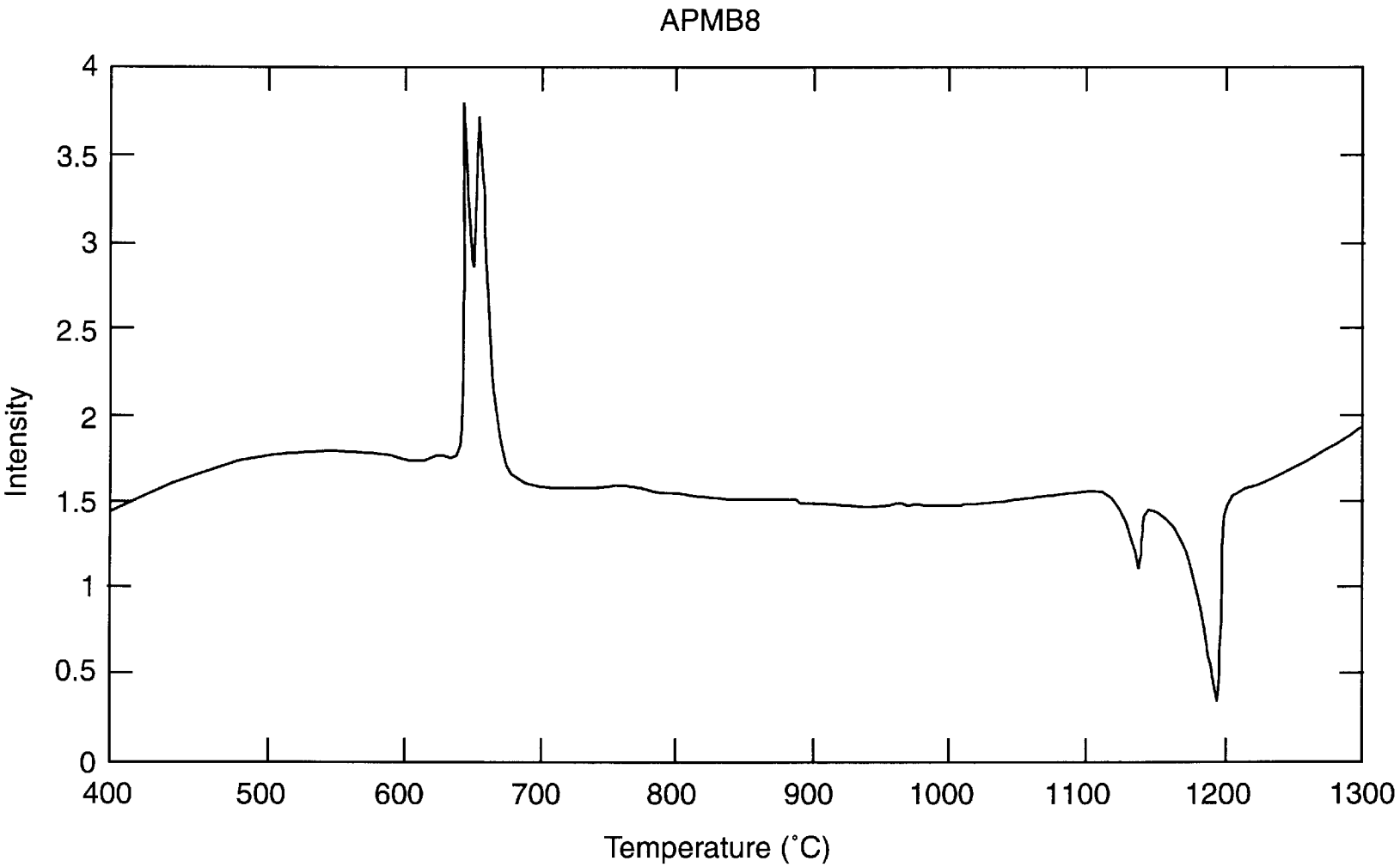

FIGS. 1A through 1L show differential thermal analysis (DTA) scans of the alloys shown in Table 1. In FIG. 1A the glass to crystalline transition for alloy APMA1 can be seen by the exothermic peak at 500° C. In FIG. 1B the glass to crystalline transition of alloy APMA8 is seen by the exothermic peak at 700° C. The extra gadolinium addition stabilized the glass phase by an additional 200° C. FIG. 1C shows the glass to crystalline transition of alloy APMB1 by the exothermic peak at 525° C., while the glass to crystalline transition of APMB8, as shown in FIG. 1D, has exothermic peaks at 650° C. and 675° C. The extra gadolinium addition therefore stabilized the glass phase by an additional 125° C.

Figure 1E:
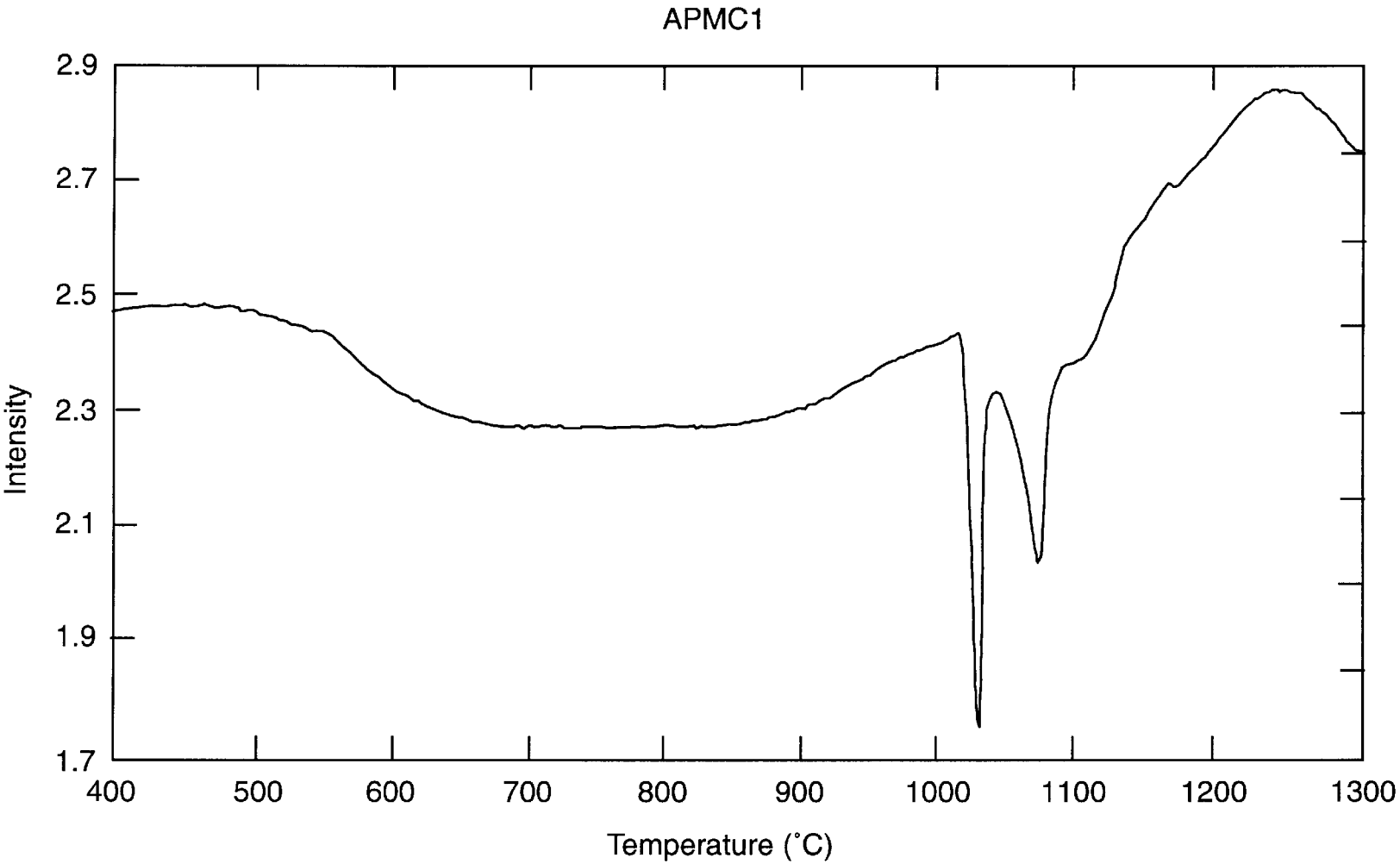
Figure 1F:
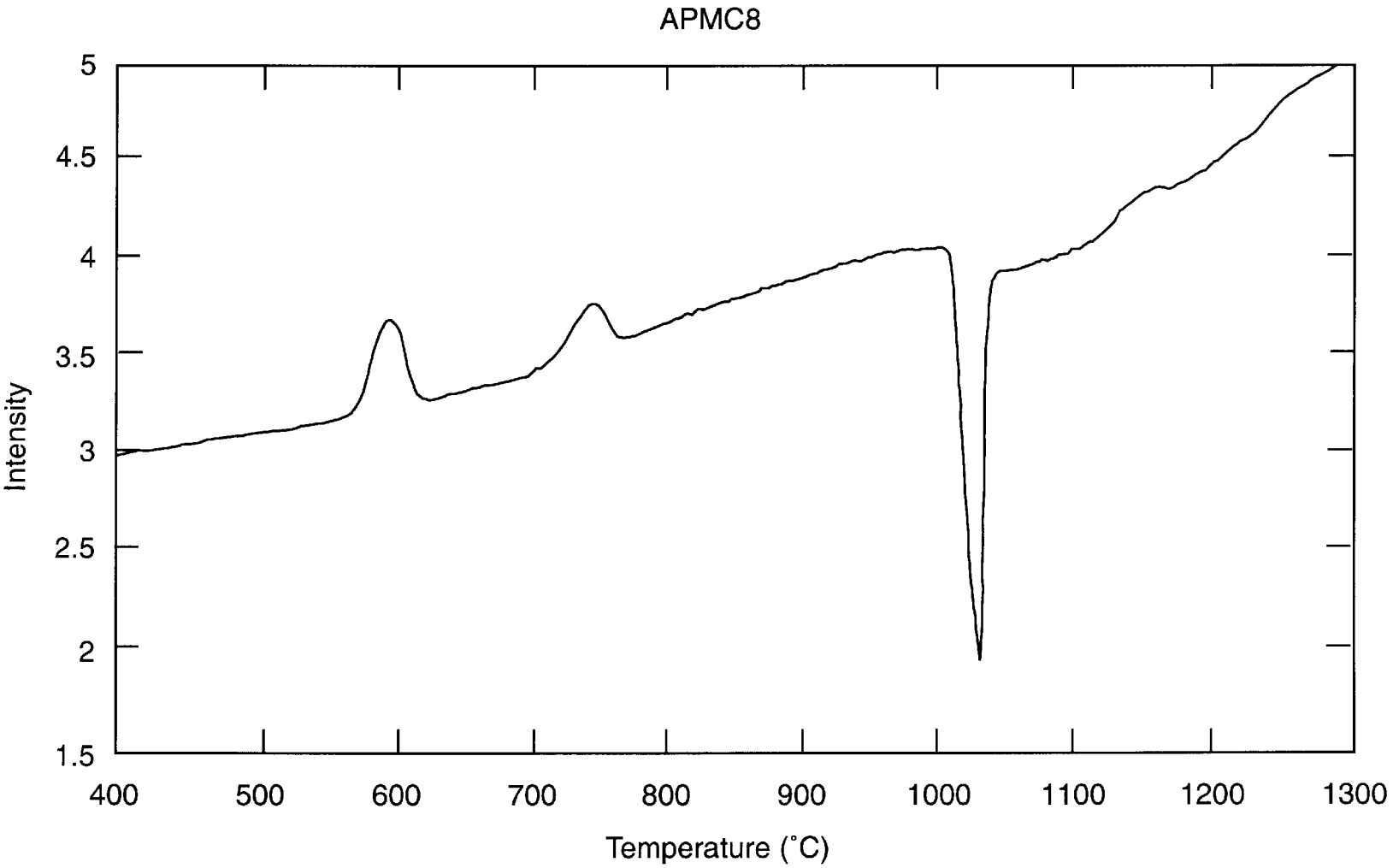
Figure 1G:
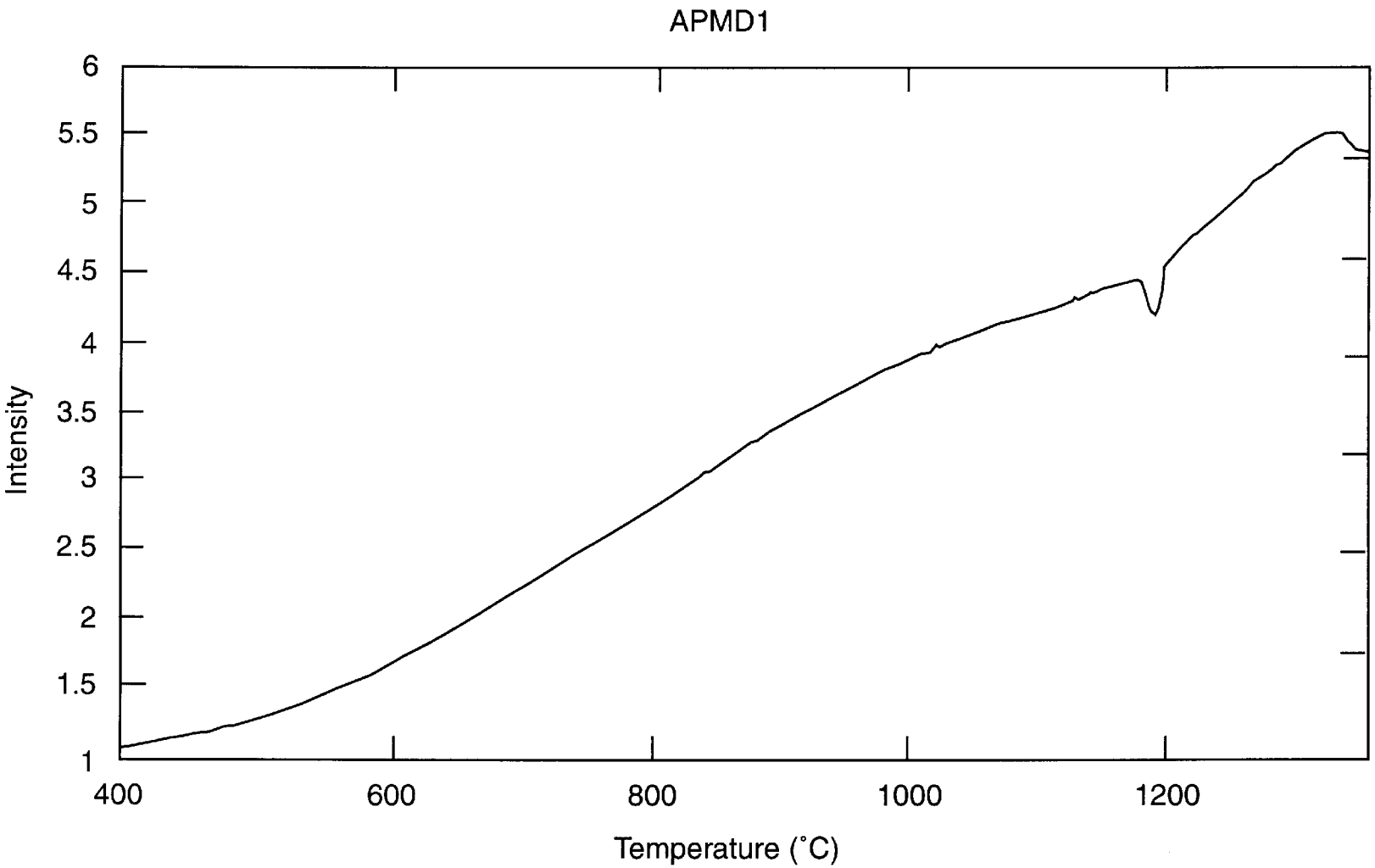
Figure 1H:
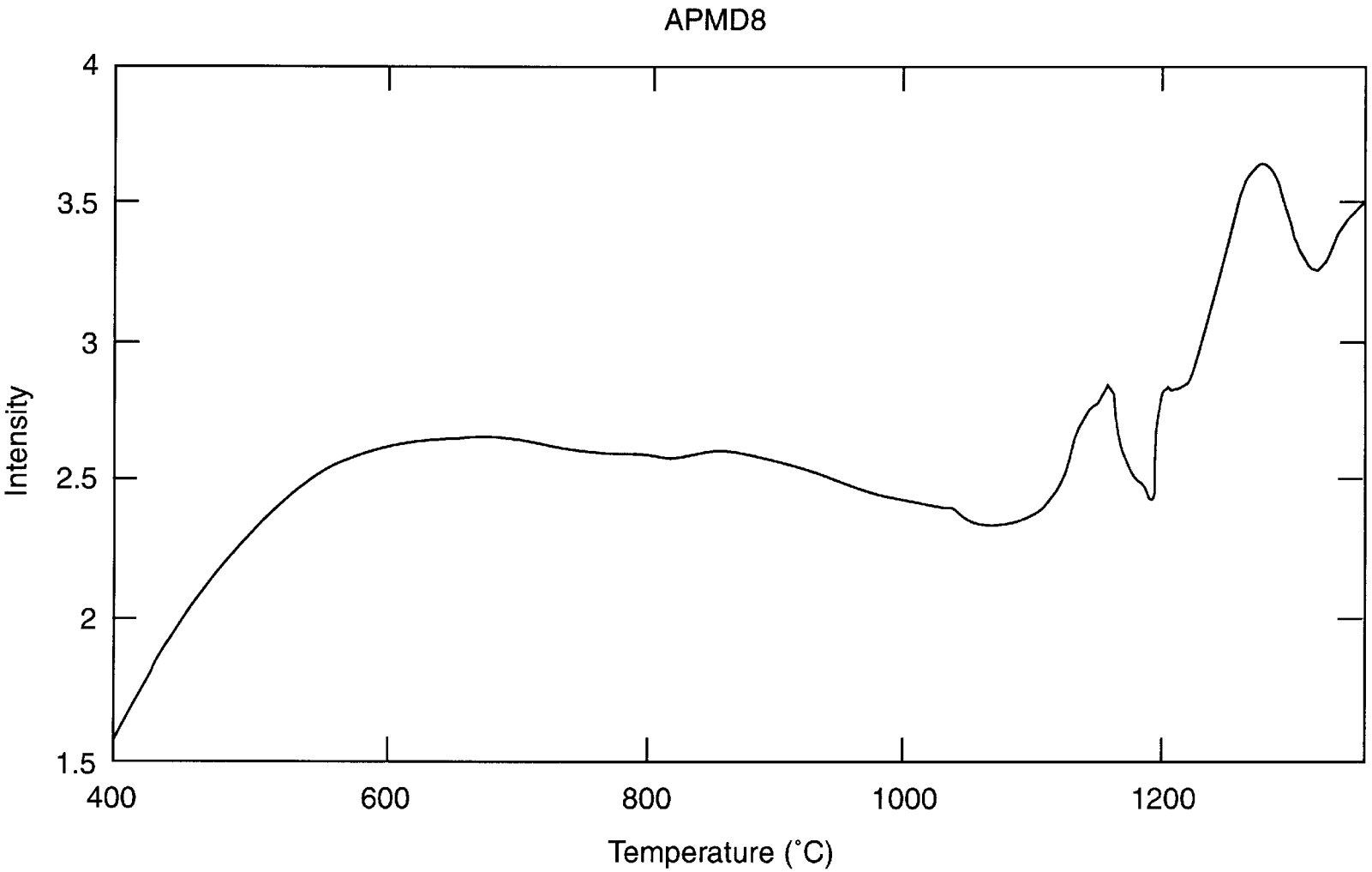
Figure 1I:
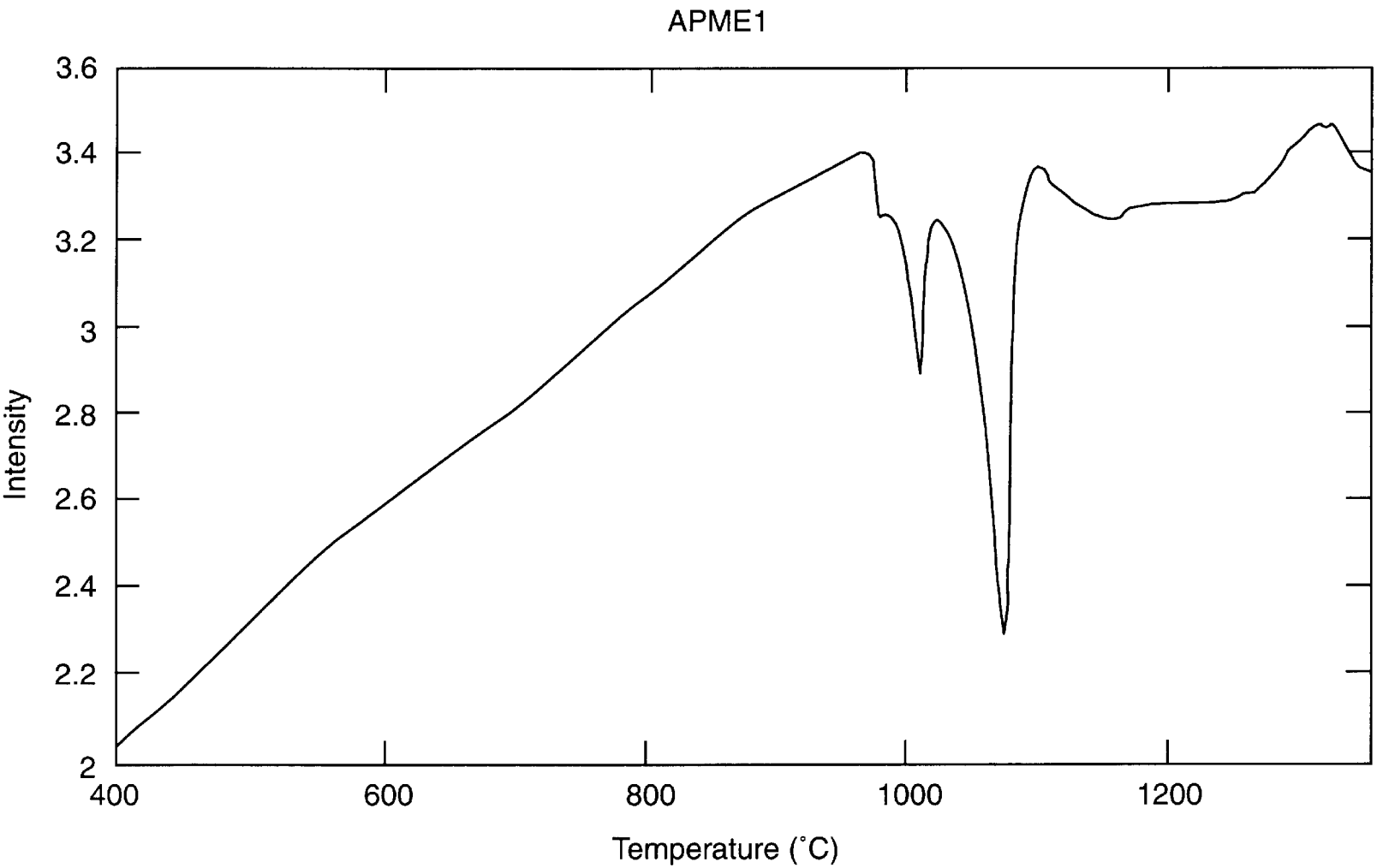
Figure 1J:
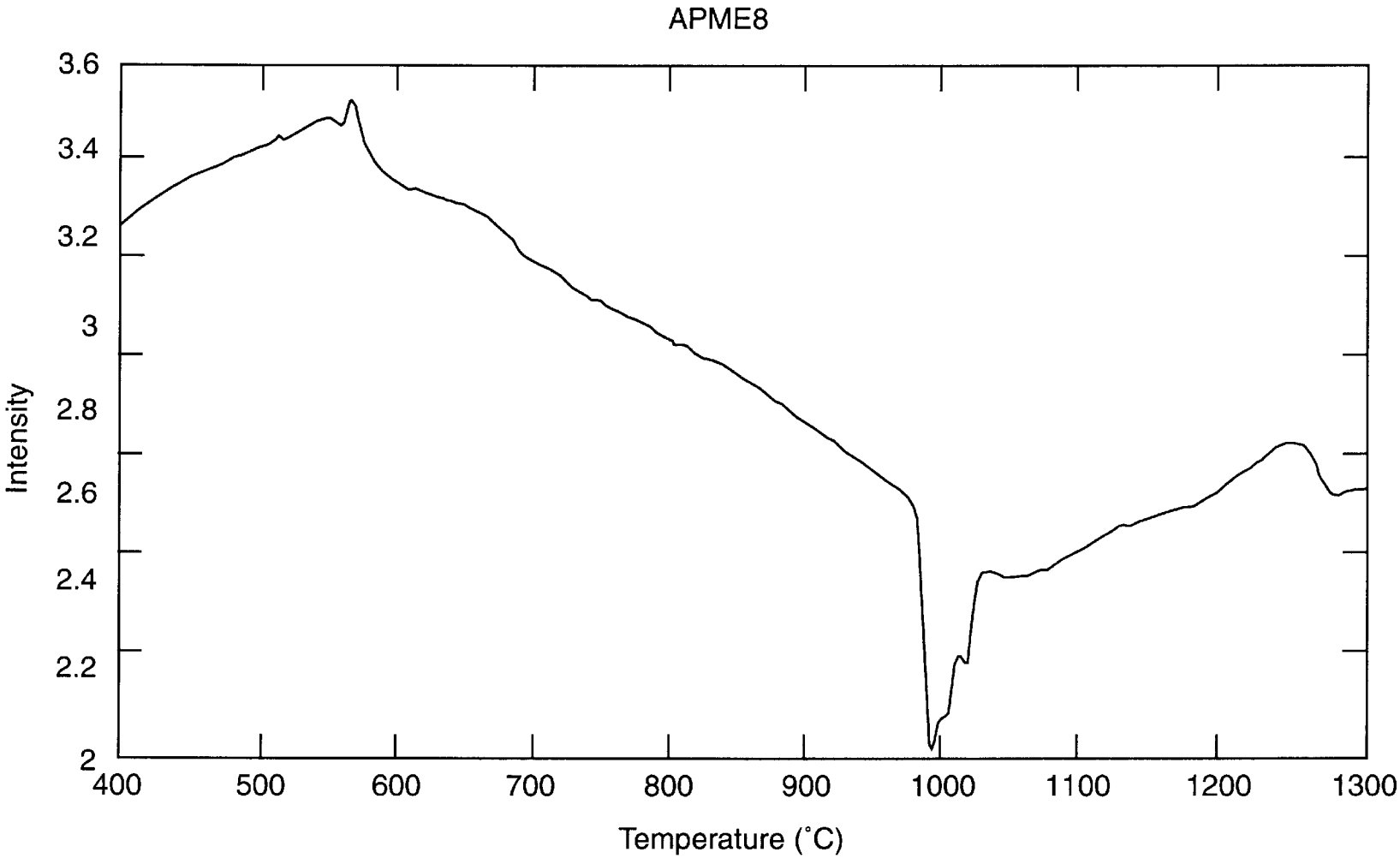

FIG. 1E shows the DTA scan for APMC1. Note that this alloy was produced in the crystalline condition. The DTA scan for APMC8 is shown in FIG. 1F. The glass to crystalline transitions can be seen by the exothermic peaks at 600° C. and 750° C. The additional gadolinium allowed the formation of the glass phase (i.e., increased glass forming ability).

FIGS. 1G, 1H, 1I and 1J show the DTA scans for alloys APMD1, APMD8, APME1, and APME8 respectively. Alloys APMD1, APMD8 and APME1 were produce in the crystalline condition. Note that in FIG. 1J the glass to crystalline transition can be seen by the exothermic peak at 600° C. The additional gadolinium allowed formation of the glass phase (i.e., increase glass forming ability).

Figure 1K:
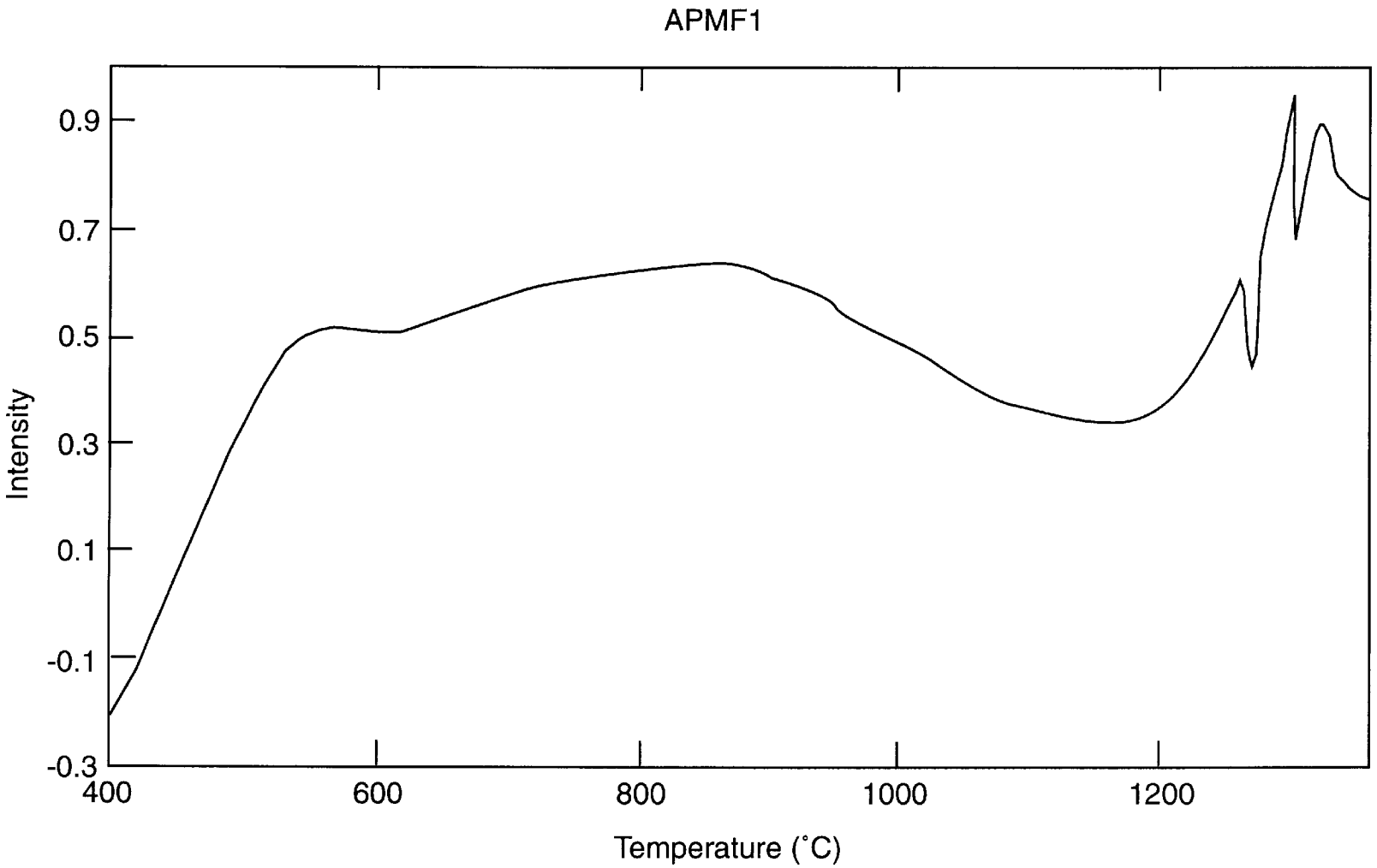
Figure 1L:
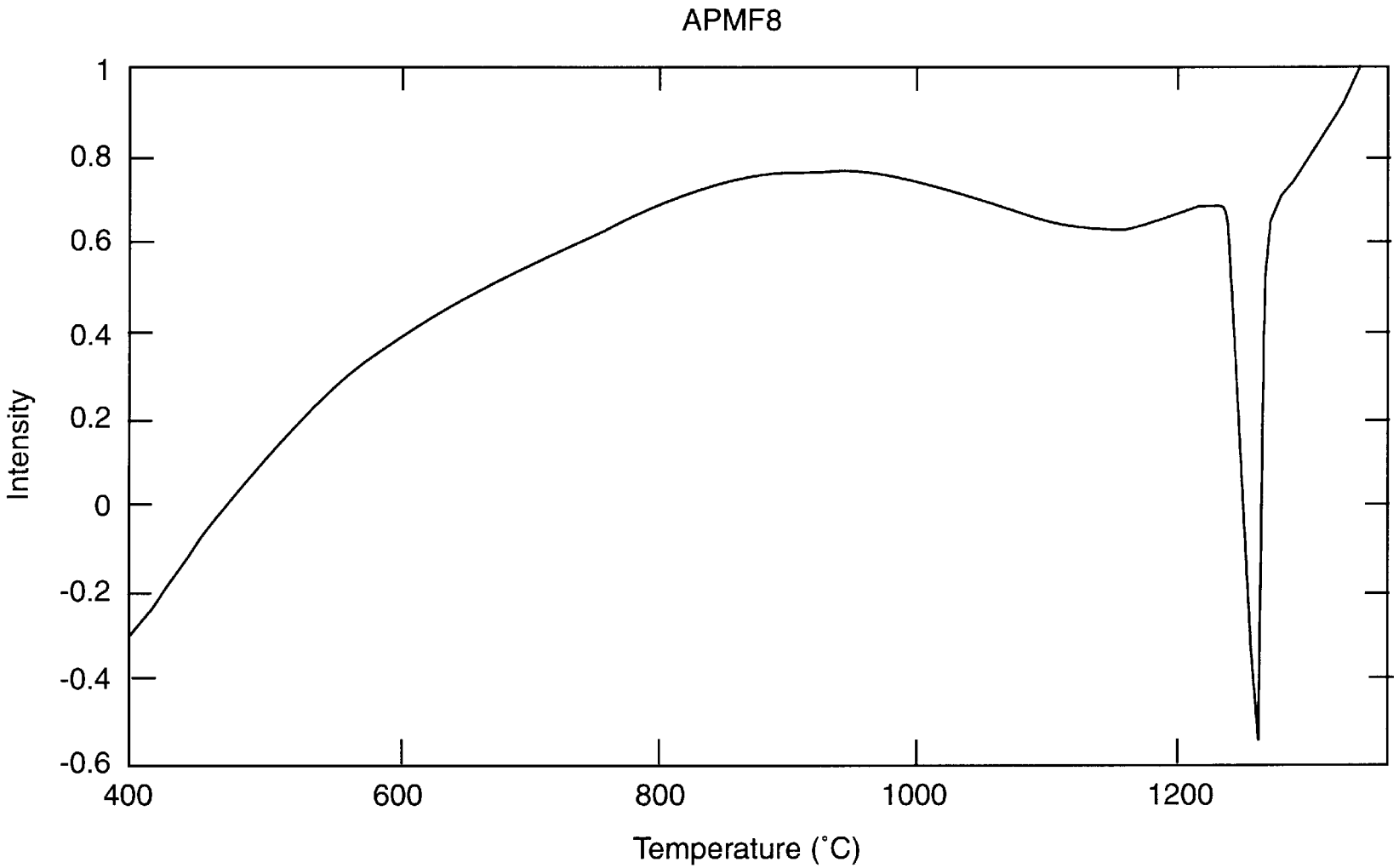
Figure 1M:
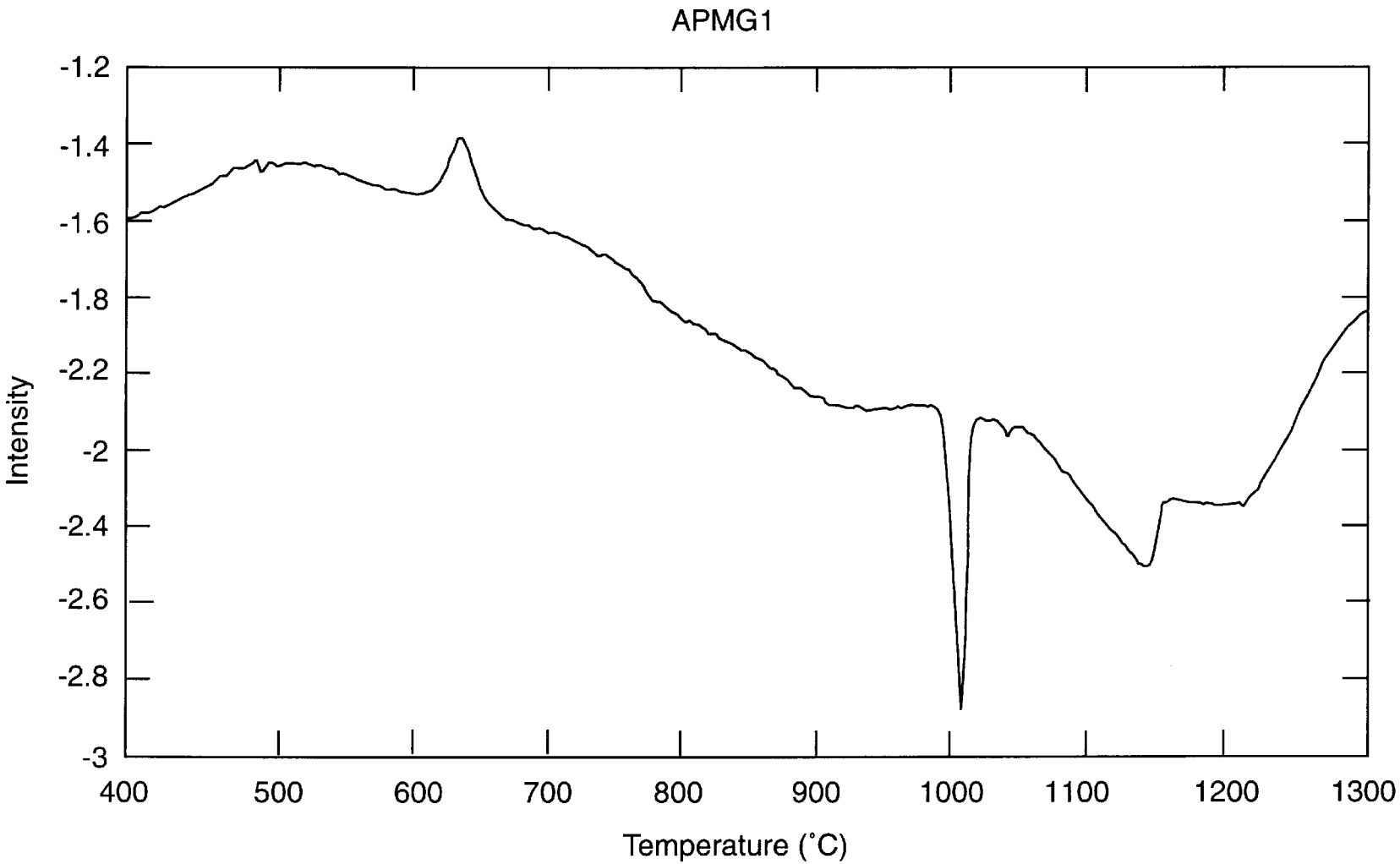
Figure 1N:
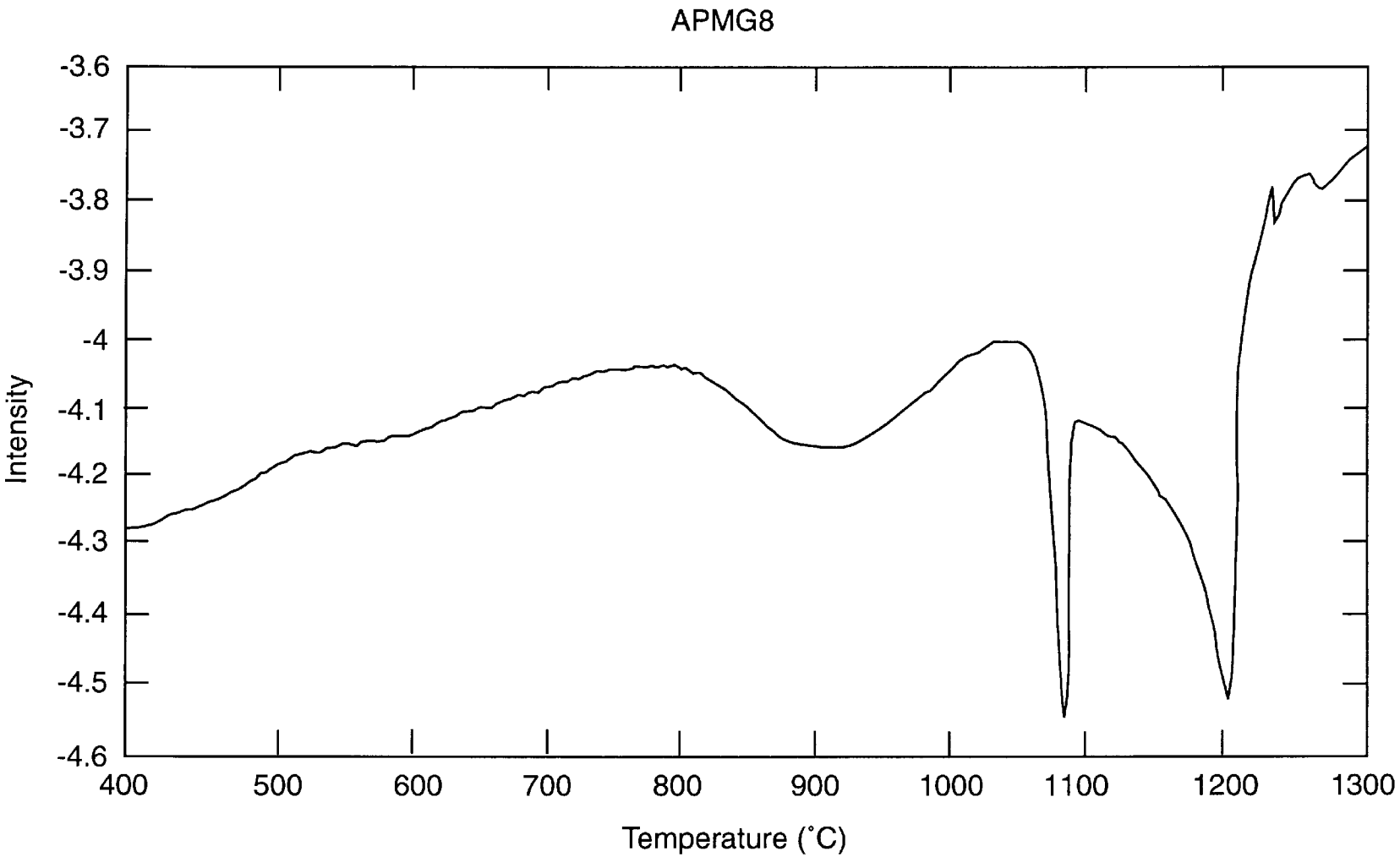

FIGS. 1K and 1L show the DTA scan for alloy APMF1 and APMF8, both of which were produced in the crystalline condition. The DTA scan for alloy APMG1 is shown in FIG. 1M. Note that the glass to crystalline transition can be seen by the exothermic peak at 650° C. In FIG. 1N, the DTA scan for alloy APMG8 is shown. This alloy was produced in the crystalline condition.

Figure 2:
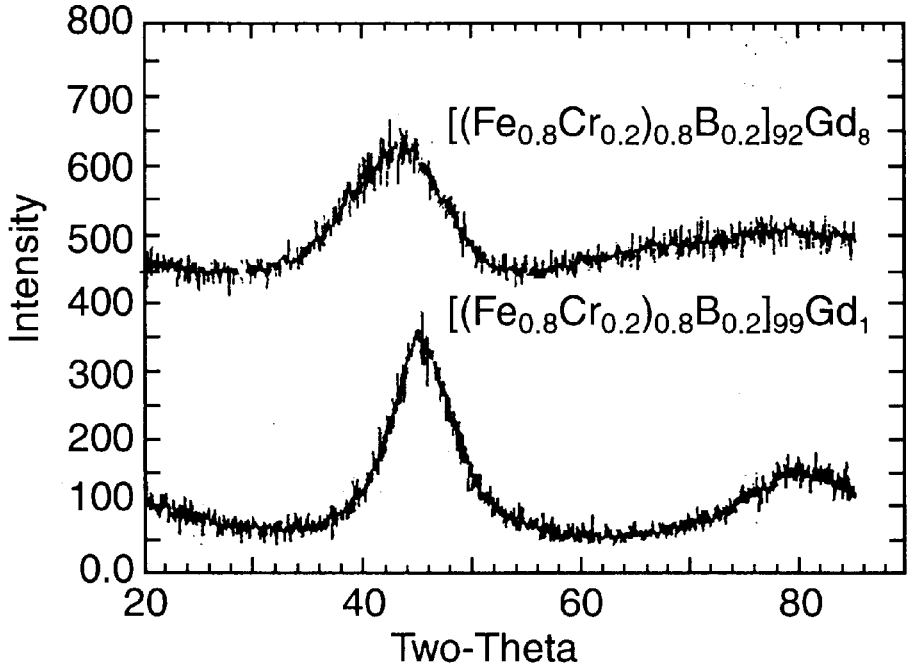
FIG. 2 is an x-ray diffraction scans for pseudo stainless steel compositions.
Figure 3:
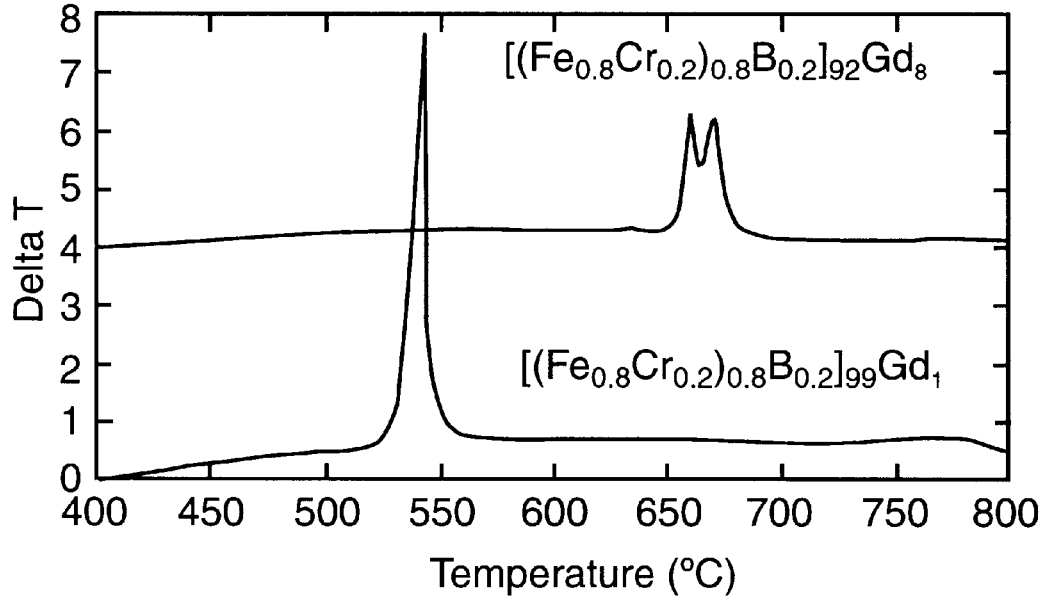
FIG. 3 is a differential thermal analysis scan comparing glass to crystalline transitions in the pseudo stainless steel alloy compositions.

FIG. 2 shows x-ray diffraction scans for pseudo stainless steel compositions (alloys APMB1 and APMB8). The absence of Bragg diffraction peaks indicate a metallic glass structure was achieved. In FIG. 3, DTA scans comparing the glass to crystalline transitions in the pseudo stainless steel alloy compositions (alloys APMB 1 and APMB8) can be seen.

The fourteen melt spun ribbon samples of the compositions listed in Table 1 have been corrosion tested in simulated J-13 well water for four days at 90° C. This is a test used to characterize corrosion behavior of materials for the Yucca Mountain Waste Repository Project. Several of the ribbon samples maintained their very shiny metallic appearance, characteristic of the pre-test conditions, after the corrosion tests. In fact, several of the alloys containing 8 at % Gd retained greater metallic luster and showed less evidence of corrosion compared to their corresponding alloys with 1 at % Gd. This trend was observed for alloys with amorphous conditions, i.e., APMB ribbons, as well as alloys If with microcrystalline structure, i.e., APMD and APMF ribbons. Although the mechanisms for corrosion resistance enhancement due to higher Gd contents have not been determined, it is believed to be due to the amorphous character, the fine crystalline phase distribution, or diffusion processes that influence the concentration of certain elements at the surface and thus effectively provide passivation. The Examples set forth are offered to illustrate and not limit the invention.

EXAMPLE 1

A modified stainless steel alloy was formed by charging to an arc-furnace suitable amounts of iron, chromium, boron, and gadolinium. The composition of the 15 gram alloy (APMB8) was 2.083 grams Cr, 8.951 grams Fe, 3.424 grams Gd, and 0.541 grams B. The solid charges were made into an alloy by arc-melting in argon on a water cooled copper hearth. The melt was homogenized by undergoing several flipping and remelting cycles.

The arc-melted alloy was contained in a quartz crucible with an exit hole diameter of 0.81 mm. The melt was heated up by Rf induction until molten at 1375° C. and then was ejected with a gas pressure of 150 torr onto a rapidly moving (25 m/s tangential velocity) copper chill wheel (5 mm melt fall). The melt rapidly solidified with cooling rates in excess of $10^5$ K/s and due to thermal contraction differences, flung off the copper wheel in the form of a tabular flake shaped ribbon (length 1 to 100 cm, width 1 cm, thickness 20 to 80 $\mu$m).

In FIG. 2, an X-ray diffraction scan of the APMB8 ribbon which has been first ground into powder is shown. The absence of any Bragg diffraction peaks indicates that the alloy has solidified with a metallic glass structure since in a metallic glass long range order is absent and only short range order is present (leading to an average atomic spacing corresponding to the amorphous hump).

In FIG. 1D, a DTA scan of the APMB8 ribbon is shown. Since a metallic glass exists in a metastable state, crystallization enthalpy will be released upon heating. The exothermic glass to metastable crystalline and metastable crystalline to crystalline transitions can be seen at 650° C. and 675° C. respectively.

EXAMPLE 2

A modified Monel alloy was formed by weighing out the appropriate amounts of copper, nickel, and gadolinium. The composition of the 8 lb alloy (alloy APMD8) in weight percent was 55.66% Ni, 25.82% Cu, and 18.52% Gd. The elements were placed into a zirconia crucible coated with BN and the crucible was placed in a close coupled annular gas atomization system. The crucible had a pour tube with an internal exit hole diameter of 0.100" (inch). The melt was heated up by Rf induction until a liquid melt temperature of 1550° C. was obtained at an argon pressure of 1 atmosphere.

The liquid melt was atomized with 350 ksi helium gas to form spherical particles with an average diameter of ≈25 μm.

Figure 4:
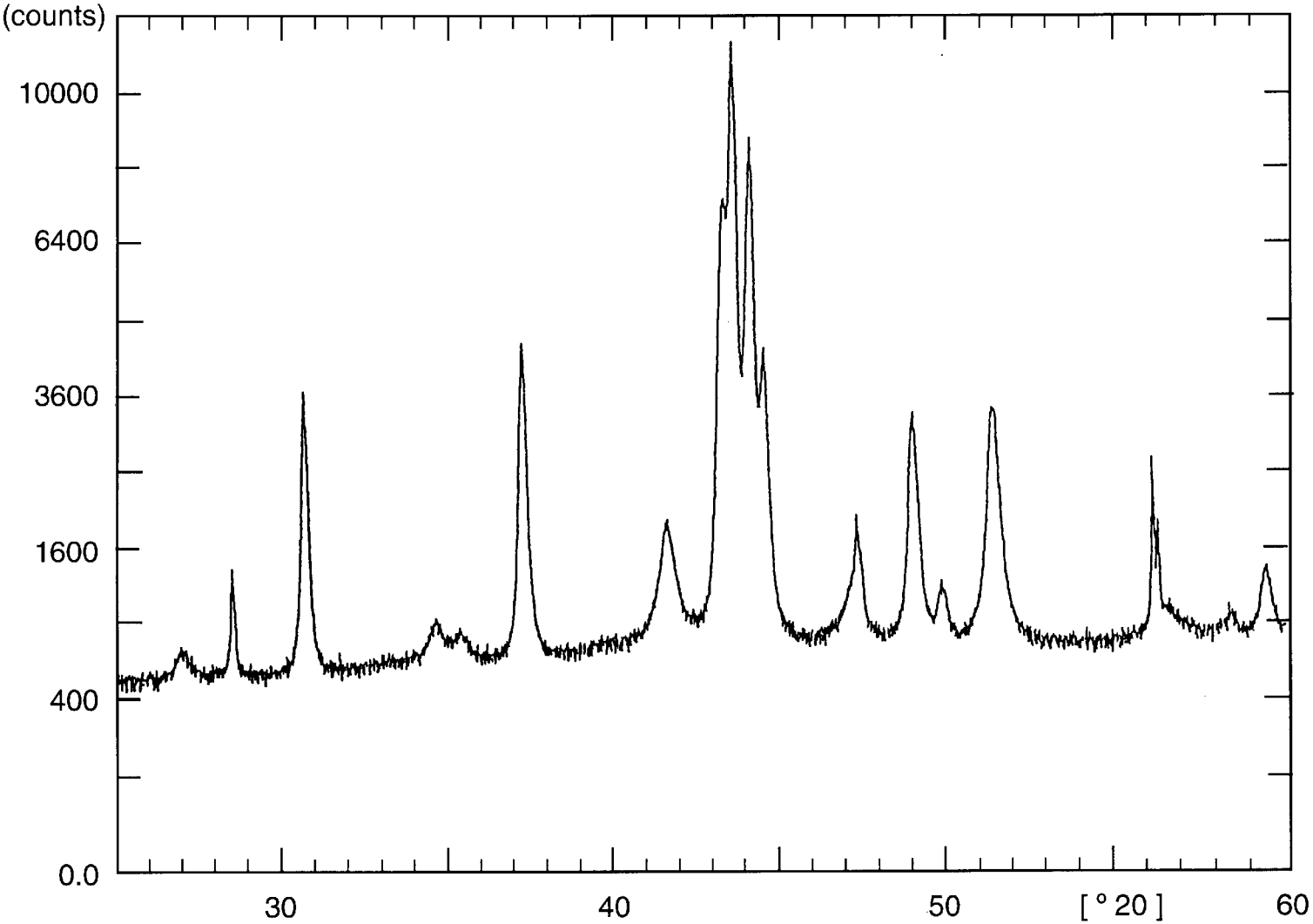
FIG. 4 is an x-ray diffraction scan of sieved 10–20 $\mu$m particles for a pseudo Monel.
Figure 5:
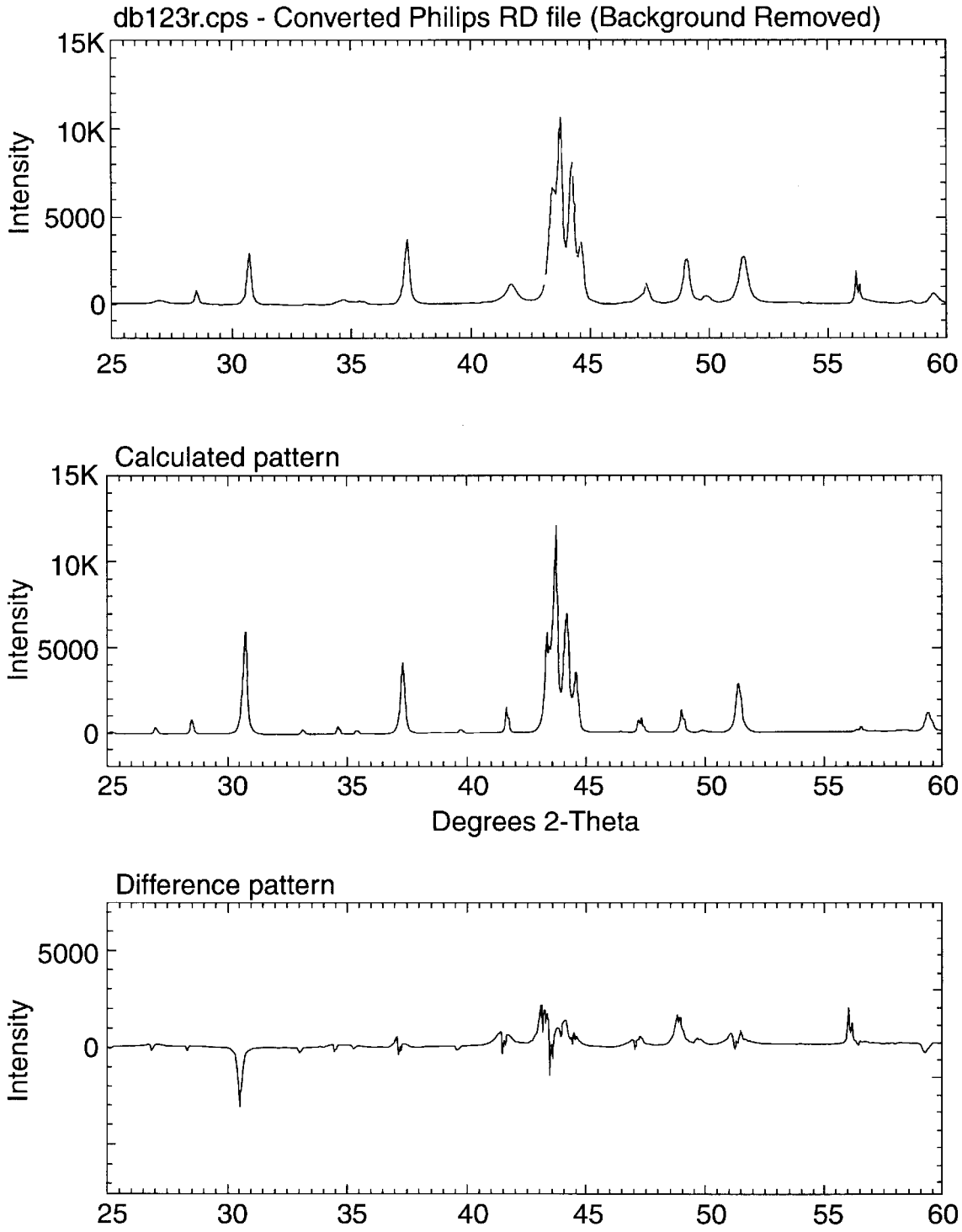
FIG. 5 shows Rieveltd analysis graphs for the 10–20 $\mu$m particles for a pseudo Monel.

An X-ray diffraction scan of sieved 10–20 μm particles is shown in FIG. 4. The many sharp Bragg diffraction peaks indicates the alloy was produced in a crystalline condition. The X-ray diffraction diagram was further refined by Rietveldt analysis as shown in FIG. 5. Three phases were identified and refined; a Cu—Ni phase with a Fm3m space group and with lattice parameter a=3.5565 Å, a $Gd(NiCu)_5$ phase with a P6/mmm space group and lattice parameters a=4.8255 Å and c=4.0721 Å, and a $Gd_2(NiCu)_{17}$ phase with a $P6_3$/mmc space group and lattice parameters a=8.3564 Å and c=8.1314 Å.

By measuring the perpendicular chord lengths off scanning electron photomicrographs and taking 100 data points, the grain sizes of the powder were obtained and compared to a conventional arc-melted ingot (produced in accordance with Example 1) at the same composition. The average grain sizes of the ingot, sieved 75 to 100 μm atomized powder, and sieved 10–20 μm atomized powder were 12.6 μm, 2.3 μm and 0.8 μm respectively.

EXAMPLE 3

A modified C-22 alloy was formed by weighing out the appropriate amounts of nickel, chromium, molybdenum, iron, tungsten, vanadium, and gadolinium. The composition of the 8 lb alloy (alloy APMF1) in weight percent was 59.21% Ni, 20.48% Cr, 12.59% Mo, 2.95% Fe, 2.06% W, 0.16% V and 2.54% Gd. The elements were placed into a zirconia crucible coated with BN and the crucible was placed in a close coupled annular gas atomization system. The crucible had a pour tube with an internal exit hole diameter of 0.090" (inch). The melt was heated up by Rf induction until a liquid melt temperature of 1650° C. was obtained at an argon pressure of 1 atmosphere. The liquid melt was atomized with 300 ksi helium gas to form spherical particles from submicron to 150 μm in diameter.

Figure 6:
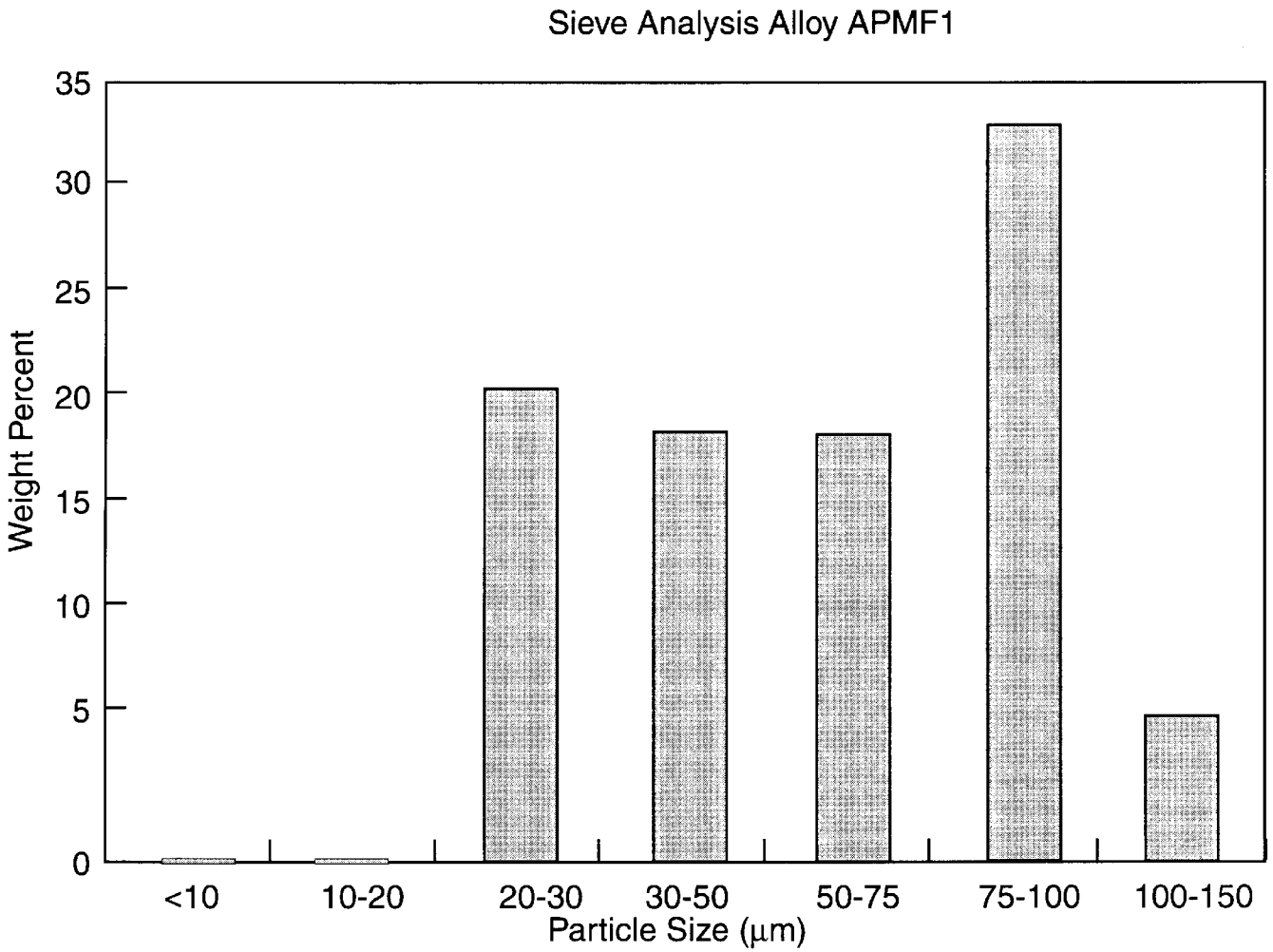
FIG. 6 is a graph showing the particle size distribution for a pseudo nickel base superalloy.

The sieve analysis of the atomized powder particles is shown in FIG. 6. Although smaller particles were observed in the SEM, only small amounts of powder could be sieved through the 10 μm sieve due to powder conglomeration due to electrostatic attraction.

Figure 7:
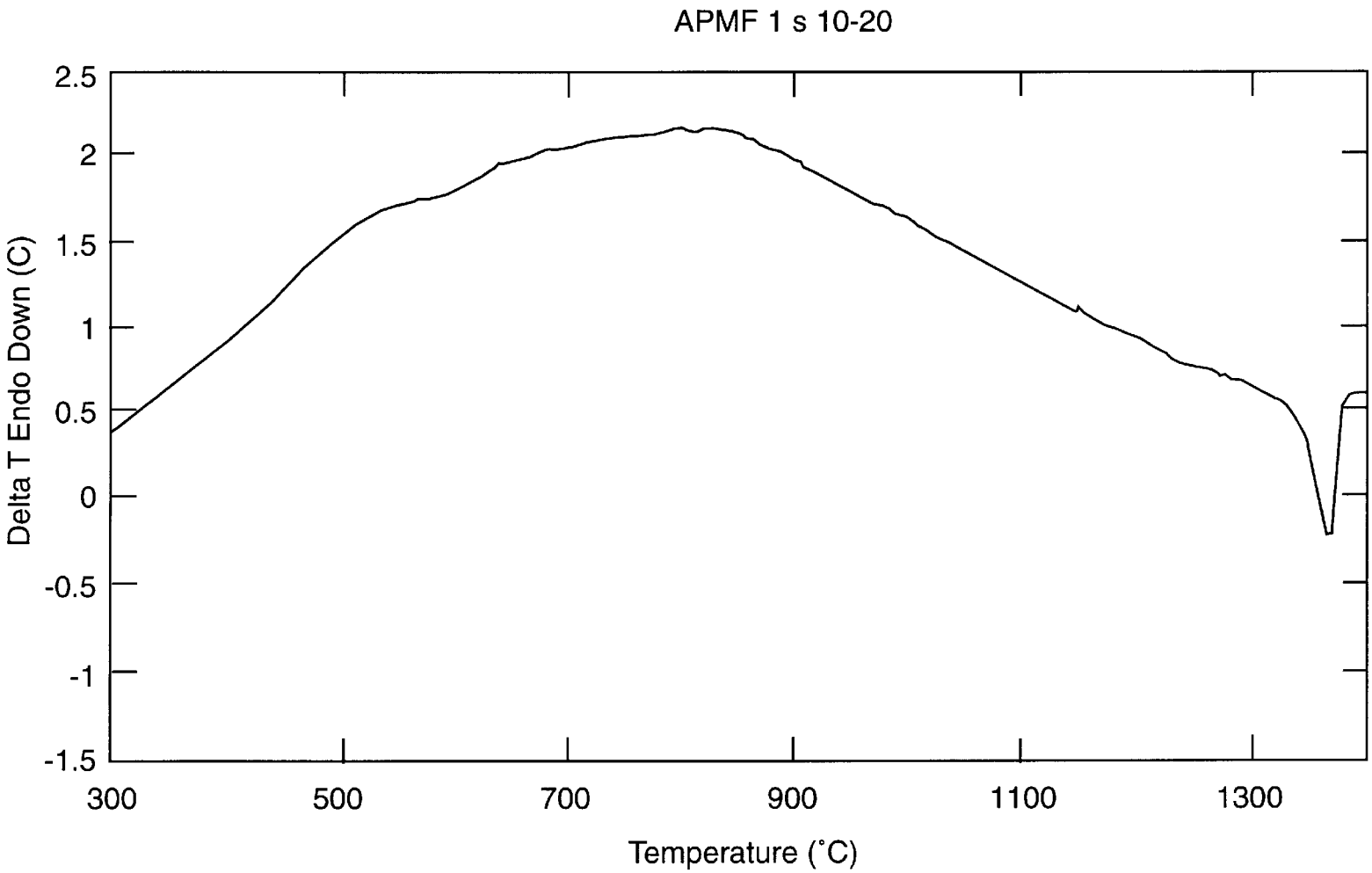
FIG. 7 is a differential thermal analysis scan for the 10–20 $\mu$m particles for a pseudo nickel base superalloy.

The DTA scan of sieved 10 to 20 μm particles is shown in FIG. 7. This figure shows that the alloy was produced in the crystalline condition since no crystallization peaks were observed. The alloy was found to melt at ≈1325° C.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical application and enable others skilled in the art to utilize the invention in various embodiments and with various modifications as are suited to the particular use contemplated. It is intended that the scope of the invention be defined by the claims appended hereto.

We claim:

1. A method of making neutron absorbing materials comprising:

a) providing a base alloy composition consisting of gadolinium and one or more transition metals, the transition metals selected from the group consisting of iron, cobalt, nickel, copper, silver and mixtures thereof;

b) forming a melt of the base alloy composition by heating the base alloy composition to a temperature above the base alloy composition melting temperature;

c) rapidly solidifying the base alloy melt using surface quenching to form ribbons of neutron absorbing materials having amorphous and fine crystalline structure.

2. The method of claim 1 wherein the total amount of gadolinium is between 0.1 to 50 atomic percent of the base alloy composition.

3. The method of claim 1 wherein the total amount of transition metals is between 50 to 99.9 atomic percent of the base alloy composition.

4. The method of claim 1 wherein the base alloy composition further comprises an interstitial element selected from the group consisting of boron, carbon, silicon and phosphorous.

5. A method of making neutron absorbing materials comprising:

a) providing a base alloy composition consisting of gadolinium and one or more transition metals, the transition metals selected from the group consisting of iron, cobalt, nickel, copper, silver and mixtures thereof;

b) forming a melt of the base alloy composition by heating the base alloy composition to a temperature above the base alloy composition melting temperature;

c) rapidly solidifying the base alloy melt using atomization methods to form particulates of neutron absorbing materials.

6. The method of claim 5 wherein the amount of gadolinium is between 0.1 to 50 atomic weight percent of the base alloy composition.

7. The method of claim 5 wherein the amount of transition metals is between 50 to 99.9 atomic weight percent of the base alloy composition.

8. The method of claim 5 wherein the base alloy composition further comprises an interstitial element selected from the group consisting of boron, carbon, silicon and phosphorous.

9. A neutron absorbing material consisting of gadolinium and one or more T, wherein T is a transition metal selected from the croup consisting of iron, cobalt, nickel, copper, silver and mixtures thereof.

10. The neutron absorbing material of claim 9 wherein gadolinium comprises between 0.1 to 50 atomic percent of the material.

11. The neutron absorbing material of claim 9 wherein T comprises between 50 to 99.9 atomic percent of the material.

12. The neutron absorbing material of claim 9 further comprising an interstitial element selected from the group consisting of boron, carbon, silicon and phosphorous.

13. The neutron absorbing material of claim 12 wherein the interstitial element comprises between 0.1 to 30 atomic percent of the material.

14. The neutron absorbing material of claim 9 wherein the material is in an atomized powder form.

15. The neutron absorbing material of claim 9 wherein the material is in the form of ribbons having amorphous and fine crystalline structure.

* * * * *